US009305521B2

(12) United States Patent
Park et al.

(10) Patent No.: US 9,305,521 B2
(45) Date of Patent: Apr. 5, 2016

(54) METHOD OF REDUCING POWER CONSUMPTION IN A DISPLAY DEVICE AND A DISPLAY DEVICE USING THE SAME

(71) Applicant: Samsung Display Co., Ltd., Yongin, Gyeonggi-do (KR)

(72) Inventors: Jong-Woong Park, Yongin (KR); Byung-Ki Chun, Yongin (KR); Yong-Seok Choi, Yongin (KR); Joo-Hyung Lee, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 346 days.

(21) Appl. No.: 13/928,334

(22) Filed: Jun. 26, 2013

(65) Prior Publication Data

US 2014/0225933 A1 Aug. 14, 2014

(30) Foreign Application Priority Data

Feb. 8, 2013 (KR) ..... 10-2013-0014684

(51) Int. Cl.
*G09G 5/10* (2006.01)

(52) U.S. Cl.
CPC ..... *G09G 5/10* (2013.01); *G09G 2320/0626* (2013.01); *G09G 2320/0666* (2013.01); *G09G 2330/021* (2013.01); *G09G 2360/16* (2013.01)

(58) Field of Classification Search
CPC ..... G09G 5/10
USPC ..... 345/690
See application file for complete search history.

(56) References Cited

U.S. PATENT DOCUMENTS

2003/0006951 A1* 1/2003 Ito ..... 345/89
2004/0178974 A1* 9/2004 Miller et al. ..... 345/82
2004/0246267 A1* 12/2004 Oohara ..... 345/591
2008/0100554 A1* 5/2008 Mori ..... 345/89

(Continued)

FOREIGN PATENT DOCUMENTS

KR 10-2008-0011845 A 2/2008
KR 10-2008-0034690 A 4/2008

(Continued)

OTHER PUBLICATIONS

Korean Patent Abstract of Publication No. 10-2008-0028222, published Mar. 31, 2008, which corresponds to Korean Patent Publication No. KR 10-0830297 B1, 1 page.

*Primary Examiner* — Jonathan Blancha
(74) *Attorney, Agent, or Firm* — Lewis Roca Rothgerber Christie LLP

(57) ABSTRACT

A display device configured to reduce power consumption, in accordance with an exemplary embodiment of the present invention, includes a signal controller configured to calculate saturation data, luminance data, and power consumption data of input image data, to calculate a compensation ratio based on a rate of change of luminance, a rate of increase of saturation, or a power consumption, to generate compensation image data having a saturation of a red, green, or blue image of the input image data increased up to a threshold value so that the compensation ratio exceeds a reference value, and to send the generated compensation image data to a data driver, and the data driver configured to supply data voltages corresponding to the compensation image data, in response to gate signals sequentially generated from a gate driver to a display panel.

16 Claims, 9 Drawing Sheets

(56) References Cited

U.S. PATENT DOCUMENTS

| | | | | |
|---|---|---|---|---|
| 2010/0194769 | A1* | 8/2010 | Mori | 345/589 |
| 2011/0292071 | A1* | 12/2011 | Kwon et al. | 345/603 |

FOREIGN PATENT DOCUMENTS

| | | | |
|---|---|---|---|
| KR | 10-0830297 | B1 | 5/2008 |
| KR | 10-2009-0015302 | A | 2/2009 |

* cited by examiner

METHOD OF REDUCING POWER CONSUMPTION IN A DISPLAY DEVICE AND A DISPLAY DEVICE USING THE SAME

CROSS-REFERENCE TO RELATED APPLICATION

This application claims priority to and the benefit of Korean Patent Application No. 10-2013-0014684, filed in the Korean Intellectual Property Office on Feb. 8, 2013, the entire content of which is incorporated herein by reference.

BACKGROUND (a) Field

Embodiments of the present invention relate to technology in which the external visibility of a display device is improved.

(b) Description of the Related Art

In general, one of the factors to be improved in an organic light emitting diode (OLED) display device is power consumption. Furthermore, external visibility also becomes an important issue in an OLED display device. Generally, to improve external visibility, a method of increasing the overall luminance of an OLED display device by supplying (e.g., additionally supplying) a consumption current to the OLED display device is used.

If external visibility is improved by supplying (e.g., additionally supplying) a consumption current to the OLED display device, there may be a problem in that power consumption suddenly increases due to an increase of luminance because the OLED display device emits light from each of its constituent pixels.

The above information disclosed in this Background section is only for enhancement of understanding of the background of the invention and, therefore, it may contain information that does not form the prior art that is already known to a person of ordinary skill in the art.

SUMMARY

Aspects of embodiments of the present invention are directed toward a method of reducing power consumption, and a display device for reducing power consumption despite increasing saturation to improve the external visibility of the display device.

Aspects of the embodiments of the present invention are directed toward a method of improving saturation, wherein saturation is increased in order to improve the external visibility of a display device, but power consumption is reduced.

According to one aspect of an embodiment of the present invention, there is provided a display device configured to reduce power consumption, the display device including a signal controller configured to calculate saturation data, luminance data, and power consumption data of input image data, to calculate a compensation ratio based on a rate of change of luminance, a rate of increase of saturation, or a power consumption, to generate compensation image data having a saturation of a red, green, or blue image of the input image data increased up to a threshold value so that the compensation ratio exceeds a reference value, and to send the generated compensation image data to a data driver, and the data driver configured to supply data voltages corresponding to the compensation image data, in response to gate signals sequentially generated from a gate driver to a display panel.

The threshold value may be a first threshold value for limiting a size of the compensation image data indicative of the green image of the input image data, and the signal controller may be configured to increase a saturation of the green image up to the first threshold value.

The threshold value may be a second threshold value for limiting a size of the compensation image data indicative of the red image of the input image, and the signal controller may be configured to increase a saturation of the red image up to the second threshold value.

The threshold value may be a third threshold value for limiting a size of the compensation image data indicative of the blue image of the input image, and the signal controller may be configured to increase a saturation of the blue image up to the third threshold value.

The signal controller may include a luminance calculator configured to calculate the luminance data of the input image and to send the calculated luminance data to a saturation adjuster, a saturation calculator configured to calculate the saturation data of the input image and to send the calculated saturation data to the saturation adjuster, a power consumption calculator configured to calculate the power consumption data of the input image and to send the calculated power consumption data to the saturation adjuster, and the saturation adjuster configured to increase image data indicative of a first color image of the input image data and to decrease one or more image data indicative of respective second and third colors of the input image data, the second color image and third color image being different from the first color image, to generate a preliminary compensation image data based on the increased image data and the decreased one or more image data, to receive compensated luminance data, compensated saturation data, and compensated power consumption data according to the preliminary generated compensation image data, to calculate the compensation ratio based on the received compensated luminance data, compensated saturation data, and compensated power consumption data, to generate compensation image data based on the calculated compensation ratio so that the calculated compensation ratio exceeds the reference value, and to send the generated compensation image data to the data driver.

The luminance data may include preceding luminance data calculated based on the luminance data of the input image data and current luminance data calculated based on the compensation image data, the saturation data may include preceding saturation data calculated based on the saturation data of the input image data and current saturation data calculated based on the compensation image data, and the power consumption data may include preceding power consumption data calculated based on the input image data and current power consumption data calculated based on the compensation image data.

The saturation adjuster may compare the preceding luminance data with the current luminance data, calculate the rate of change of luminance based on a result of the comparison of the luminance data, compare the preceding saturation data with the current saturation data, calculates the rate of change of saturation based on a result of the comparison of the saturation data, calculate the compensation ratio using the rate of change of luminance and the rate of change of saturation, compare the preceding power consumption data with the current power consumption data, and calculate a rate of change of power consumption based on a result of the comparison of the power consumption data.

The current power consumption data of the compensation image data may be smaller than or equal to the preceding power consumption data.

The signal controller may include an external illuminance measurement unit, and may be configured to generate the compensation image data based on an external measured illuminance, and to send the generated compensation image data to the data driver.

According to an example embodiment of the present invention, there is provided a method of reducing power consumption, including the acts of: (A) calculating first saturation data, first luminance data, and first power consumption data of input image data, (B) increasing a saturation of a red, green, or blue image of the input image data, (C) calculating second saturation data, second luminance data, and second power consumption data of the image data including the increased saturation, (D) calculating a rate of change of luminance using the first luminance data and the second luminance data, calculating a rate of change of saturation using the first saturation data and the second saturation data, and calculating a compensation ratio based on the rate of change of luminance and the rate of change of saturation; and (E) comparing the first power consumption data with the second power consumption data and increasing image data of the red, green, or blue of the input image data by repeating the acts (B) to (D) so that the compensation ratio exceeds a threshold value within a range in which the second power consumption data is same as the first power consumption data or smaller based on a result of the comparing the first power consumption data with the second power consumption data.

The threshold value may be a first threshold value limiting a size of compensation image data indicative of the green image of the input image data, and the act (E) may include increasing a saturation of the green image up to the first threshold value.

The threshold value may be a second threshold value limiting a size of compensation image data indicative of a red image of the input image, and the act (E) may include increasing a saturation of the red image up to the second threshold value.

The threshold value may be a third threshold value limiting a size of compensation image data indicative of a blue image of the input image data, and the act (E) may include increasing a saturation of the blue image up to the third threshold value.

The act (B) may include increasing image data of a first color image of the input image data and decreasing image data of one or more of a second color image and a third color image of the input image data, the second color image and third color image being different from the first color image.

The method of reducing power consumption and the display device for reducing power consumption in accordance with example embodiments of the present invention are advantageous in that power consumption is reduced and external color visibility is also improved.

DETAILED DESCRIPTION

Figure 1:
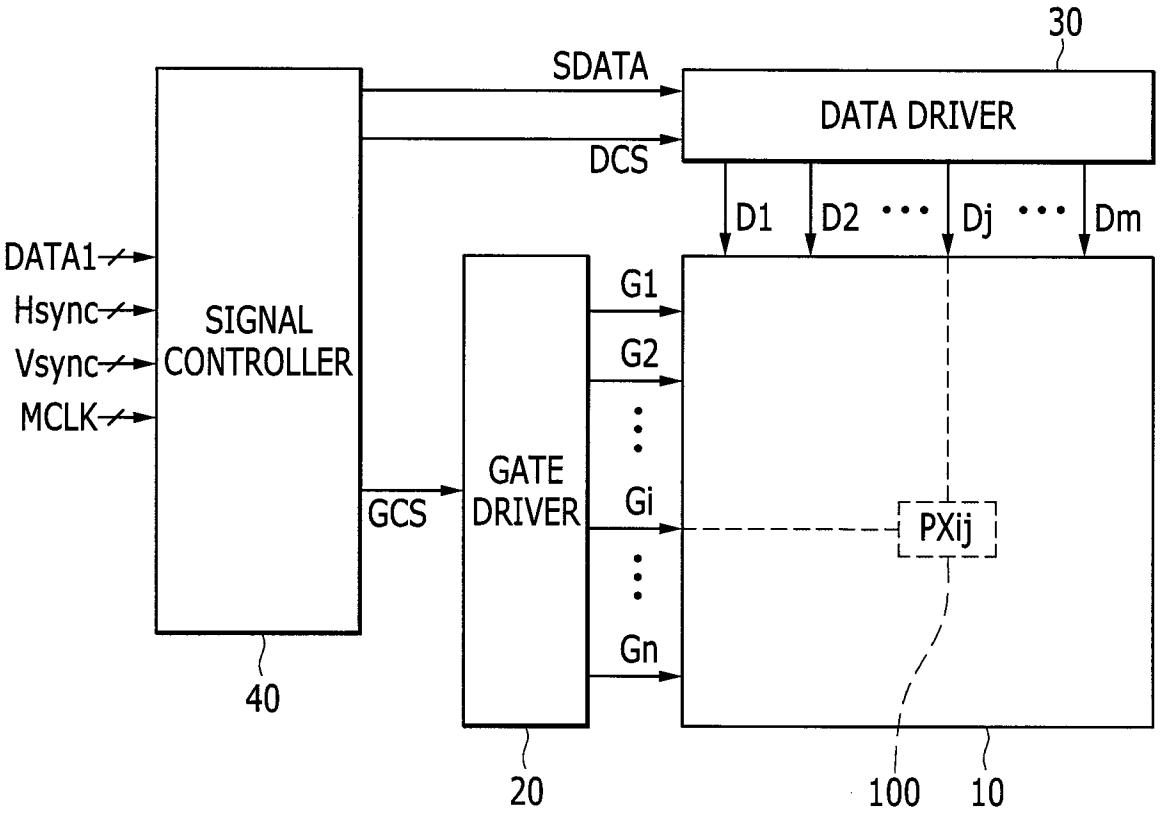
FIG. 1 is a block diagram showing a display device for reducing power consumption in accordance with an example embodiment of the present invention.

Hereinafter, some example embodiments of the present invention are described in more detail with reference to the accompanying drawings in order for those skilled in the art to be able to readily implement the invention. As those skilled in the art would realize, the described embodiments may be modified in various ways, all without departing from the spirit or scope of the present invention.

Furthermore, the drawings and description are to be regarded as illustrative in nature and not restrictive. Like reference numerals designate like elements throughout the specification.

In the entire specification, unless explicitly described to the contrary, the word "comprise" and variations, such as "comprises" or "comprising," will be understood to imply the inclusion of stated elements but not the exclusion of any other elements. In addition, the suffixes "-er" and "-or" and the term "module," used in the specification, imply reference to or mean units for processing at least one function and operation and can be implemented by hardware components or software components and combinations thereof.

FIG. 1 is a block diagram showing a display device for reducing power consumption in accordance with an example embodiment of the present invention.

As shown in FIG. 1, the display device for reducing power consumption in accordance with an example embodiment of the present invention includes a display panel 10 configured to include a plurality of pixels 100, a gate driver 20, a data driver 30, and a signal controller 40 configured to control the display panel 10, the gate driver 20, and the data driver 30.

The display panel 10 includes the plurality of pixels disposed at regions where a plurality of gate lines G1 to Gn crosses (e.g., intersects) a plurality of data lines D1 to Dm, respectively.

Each of the plurality of pixels can include a sub-pixel having RGB colors.

Each of the plurality of pixels is coupled (or connected) to a corresponding gate line of the plurality of gate lines G1 to Gn and a corresponding data line of the plurality of data lines D1 to Dm, and the plurality of pixels is arranged in a matrix form.

The plurality of gate lines G1 to Gn may be approximately extended in the row direction of the plurality of pixels, and the plurality of data lines D1 to Dm may be approximately extended in the column direction of the plurality of pixels. In another embodiment, each of the plurality of gate lines G1 to Gn and the plurality of data lines D1 to Dm may be parallel to each other.

The display panel 10 receives data voltages corresponding to a compensation image data signal SDATA via the data driver 30 from the signal controller 40, in response to data signals sequentially received from the gate driver 20, and displays images compensated by the signal controller 40.

Here, the compensation image data signal SDATA transferred to the data driver 30 is an image data signal that is compensated by the signal controller 40 in accordance with an example embodiment of the present invention. The image data signal that is compensated by the signal controller 40 is hereinafter called the compensation image data signal SDATA.

A compensation operation is performed in such a manner that saturation (or color saturation) is increased so that a compensation ratio set by taking a rate of change of luminance, a rate of increase of saturation, and power consumption into consideration exceeds a reference value (e.g., predetermined reference value) and that power consumption is reduced before compensation or is at least equal to power consumption before compensation. Here, the reference value can be set depending on a design condition.

The display panel 10 may be an organic light emitting diode (OLED) display panel, but is not specially limited thereto.

The gate driver 20 is controlled in response to the gate driving control signal GCS of the signal controller 40. The gate driver 20 generates a plurality of gate signals and supplies the plurality of gate signals to the plurality of gate lines G1 to Gn coupled to the display panel 10.

The gate driver 20 can include a shift register for sequentially generating the plurality of gate signals in response to a start signal of the gate driving control signal GCS generated from the signal controller 40 and a level shift for shifting voltage levels of the plurality of gate signals to voltage levels suitable for driving the plurality of pixels.

The data driver 30 samples the compensation image data signal SDATA in response to a data driving control signal DCS generated from the signal controller 40, latches the sampled compensation image data signal SDATA for every line, converts the latched image data signals into the plurality of data voltages, and supplies the plurality of data voltages to a plurality of pixels selected in response to a gate signal.

The signal controller 40 is coupled to the gate driver 20 and the data driver 30. The signal controller 40 generates the gate control signals GCS and data control signals DCS for controlling the gate driver 20 and the data driver 30, respectively, in response to an external original image data signal DATA1, a horizontal synchronization signal Hsync, a vertical synchronization signal Vsync, and a clock signal MCLK, and the signal controller 40 supplies the gate and data control signals GCS and DCS to the gate driver 20 and the data driver 30, respectively.

Here, the original image data signal DATA1 is not an image signal having changed saturation by which power consumption is reduced, but is a pure original image data signal.

The signal controller 40 can receive an RGB image signal, including the grayscale data of respective red R, green G, and blue B, as the original image data signal DATA1.

The signal controller 40 in accordance with an example embodiment of the present invention can further include a saturation adjustment unit 50 for generating the compensation image data signal SDATA in response to the original image data signal DATA1.

The saturation adjustment unit 50 calculates saturation data, luminance data, and the power consumption of each of the RGB images of the original image data signal DATA1, generates the compensation image data signal SDATA corresponding to the original image data signal DATA1, and sends the generated compensation image data signal SDATA to the data driver 30.

The saturation adjustment unit 50 includes an external illuminance measurement unit. The saturation adjustment unit 50 can convert the saturation data of the respective RGB images of an input image based on an external measured illuminance, generate the compensation image data signal SDATA based on the converted saturation data, and send the generated compensation image data signal SDATA to the data driver 30.

In accordance with the display device of the embodiment of FIG. 1, a user can view and/or check an image compensated by the signal controller 40 through the display panel 10.

Figure 2:
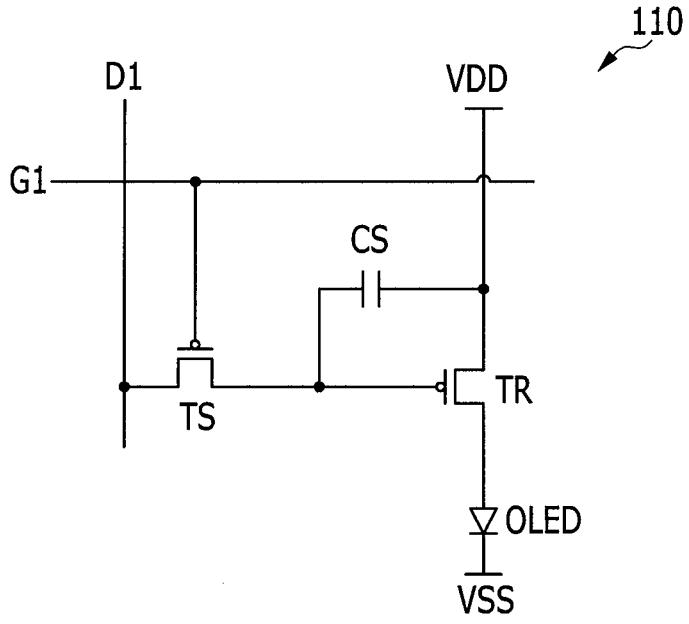
FIG. 2 is a schematic diagram showing a pixel circuit of a display panel in accordance with an example embodiment of the present invention.

FIG. 2 is a diagram showing the pixel circuit of the display panel 110 in accordance with an example embodiment of the present invention.

As shown in FIG. 2, the pixel circuit 110 of the display panel 10 includes a switching transistor TS, a driving transistor TR, and a storage capacitor CS. Voltage VSS is coupled to the cathode of an OLED.

The switching transistor TS includes a gate electrode coupled to the gate line G1, a first electrode coupled to the data line D1, and a second electrode.

The driving transistor TR includes a gate electrode coupled to the second electrode of the switching transistor TS, a source electrode coupled to voltage VDD, and a drain electrode coupled to the anode of the OLED.

The storage capacitor CS is coupled between the gate electrode and source electrode of the driving transistor TR.

When the switching transistor TS is turned on in response to the scan signal of a gate-on voltage transferred through the gate line G1, the data signal is supplied to the gate electrode of the driving transistor TR through the data line D1. The storage capacitor CS maintains a voltage corresponding to the data signal transferred to the gate electrode of the driving transistor TR.

Accordingly, a driving current corresponding to the voltage maintained by the storage capacitor CS flows through the driving transistor TR. The driving current flows through the OLED and the OLED emits light with luminance corresponding to the driving current.

Figure 3:
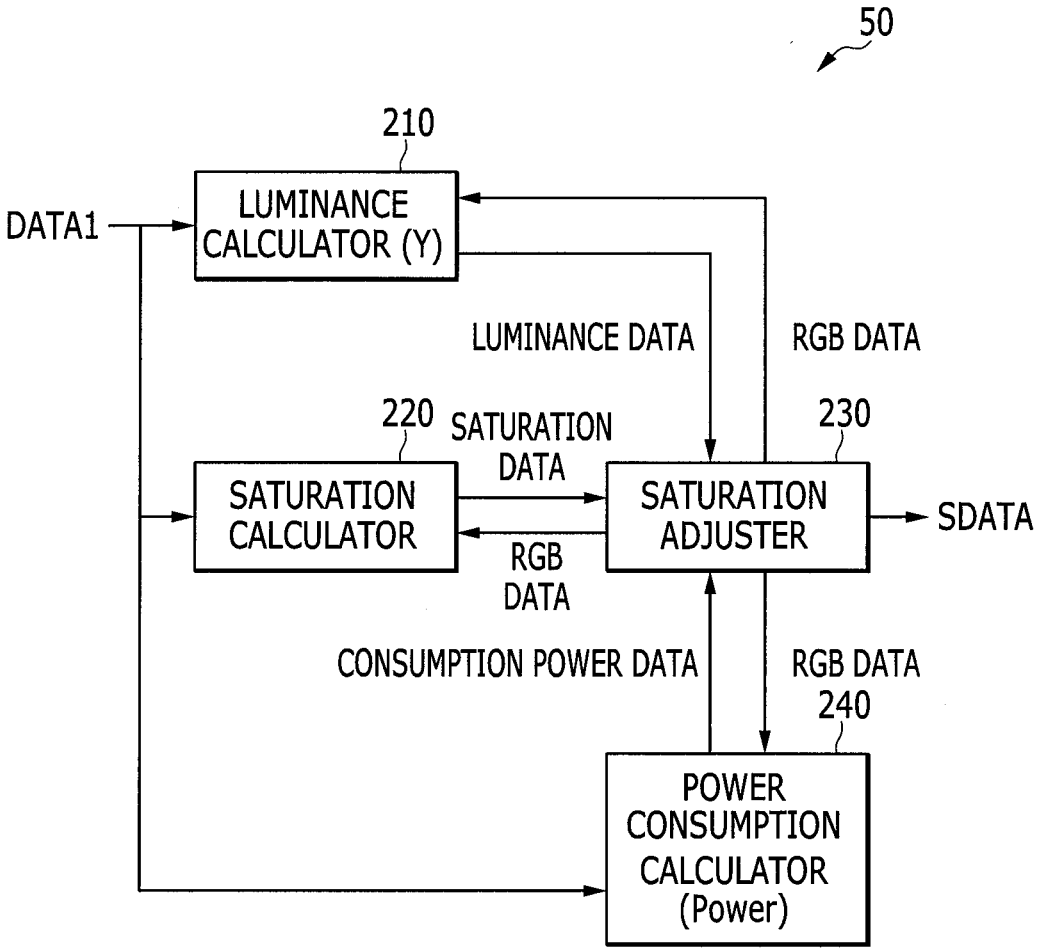
FIG. 3 is a block diagram of a saturation adjustment unit in accordance with an example embodiment of the present invention.

FIG. 3 is a block diagram of the saturation adjustment unit 50 in accordance with an example embodiment of the present invention.

Figure 4:
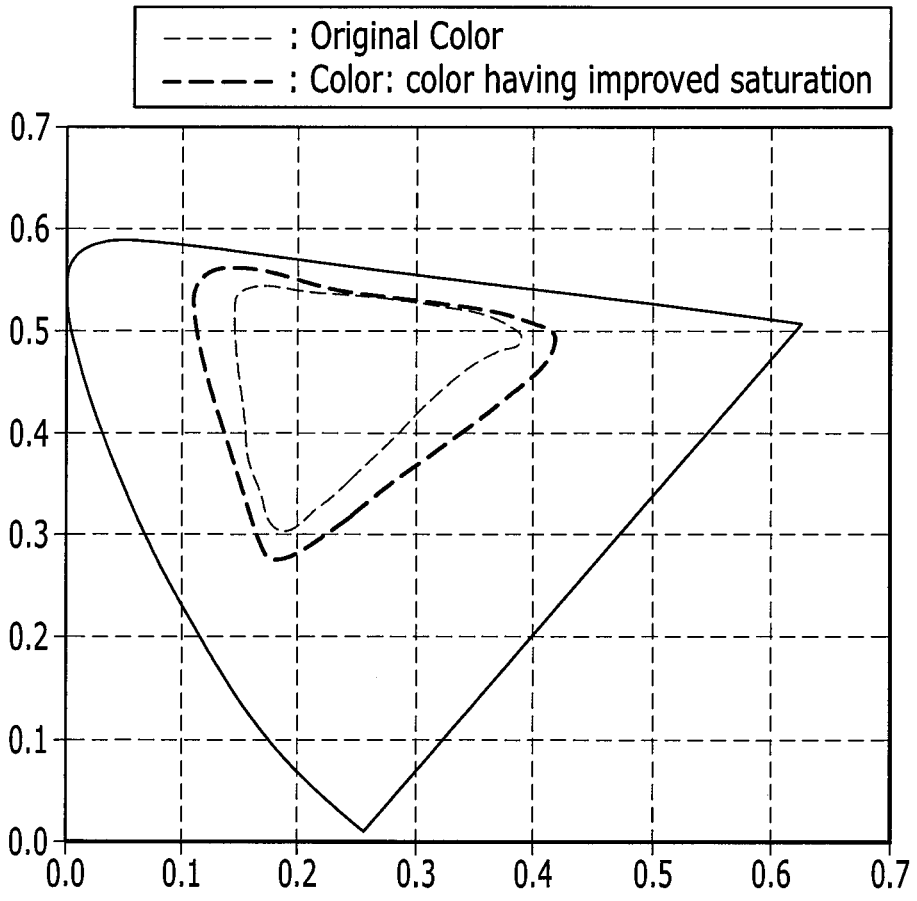
FIG. 4 is a graph showing CIE 1976 color coordinates for improving the saturation of the saturation adjustment unit in accordance with an example embodiment of the present invention.

FIG. 4 is a graph showing CIE 1976 color coordinates for improving the saturation of the saturation adjustment unit 50 in accordance with an example embodiment of the present invention.

Figure 5:
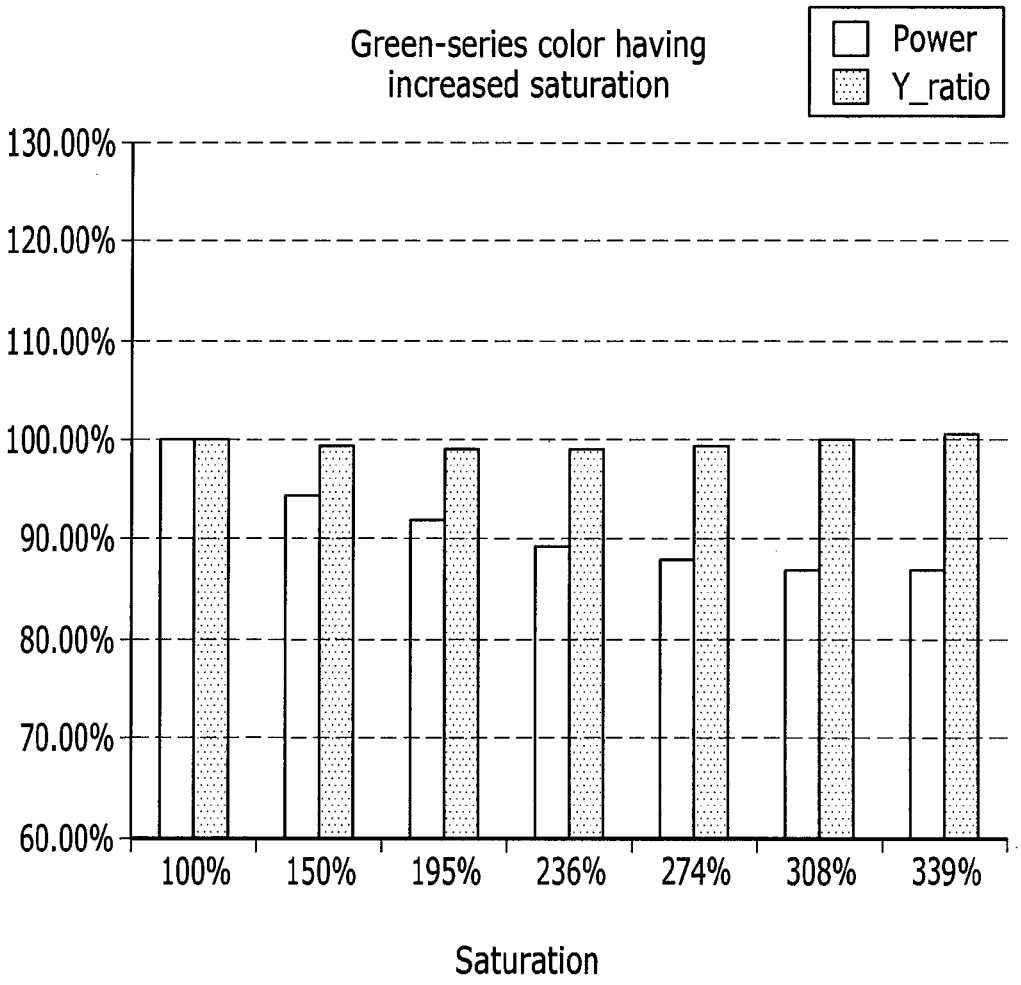
FIG. 5 is a graph showing an increase in the green-series saturation of the saturation adjustment unit in accordance with an example embodiment of the present invention.

FIG. 5 is a graph showing an increase in the green-series saturation of the saturation adjustment unit 50 in accordance with an example embodiment of the present invention.

Figure 6:
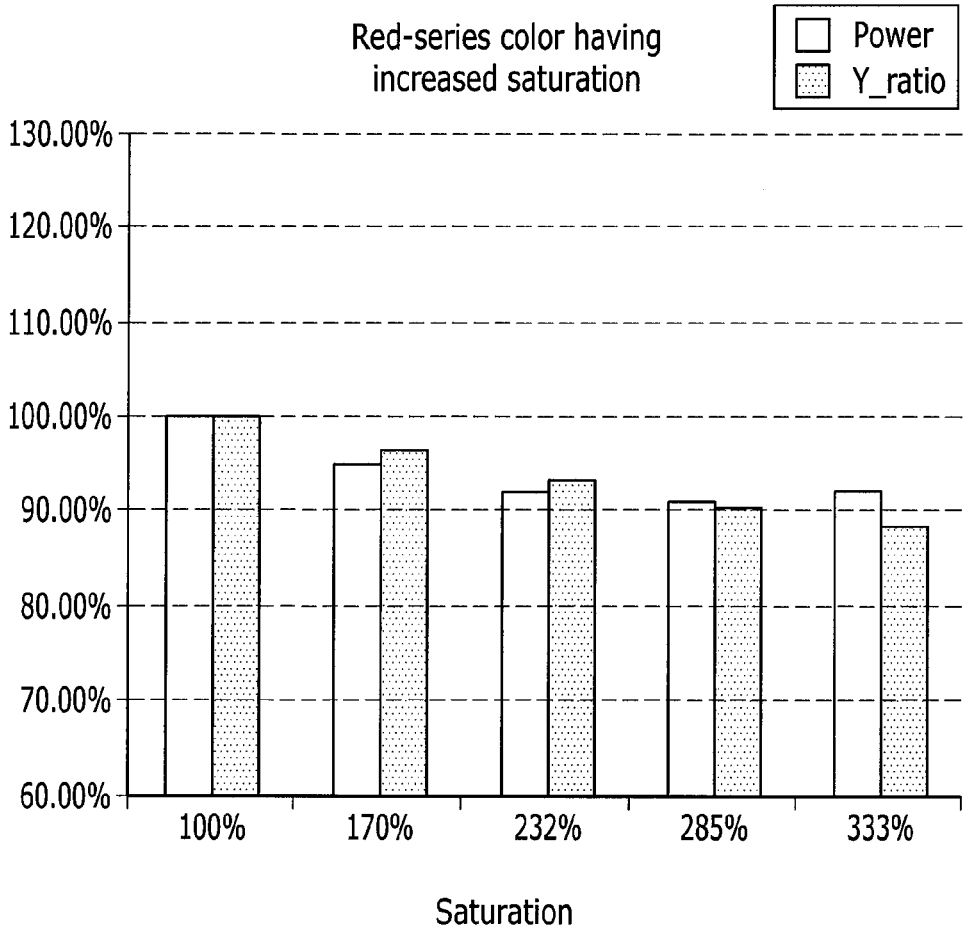
FIG. 6 is a graph showing an increase in the red-series saturation of the saturation adjustment unit in accordance with an example embodiment of the present invention.

FIG. 6 is a graph showing an increase in the red-series saturation of the saturation adjustment unit 50 in accordance with an example embodiment of the present invention.

Figure 7:
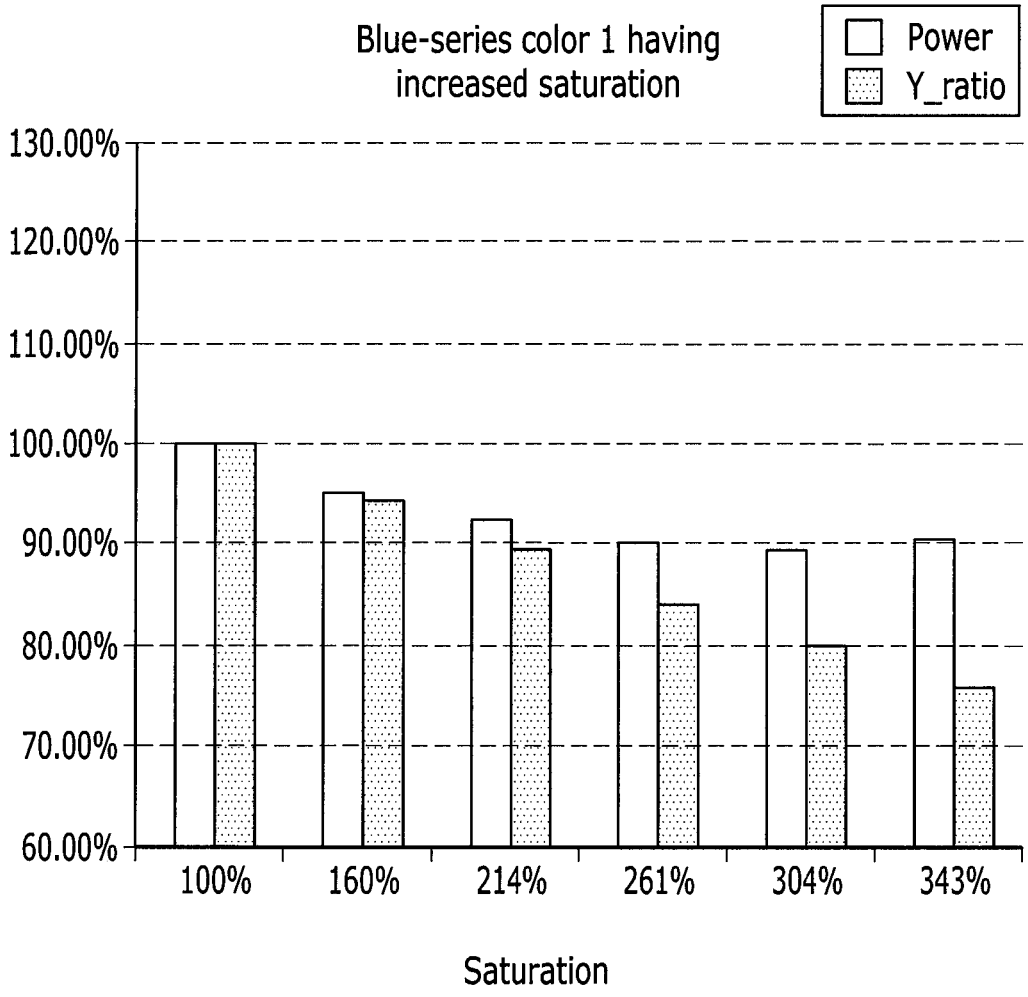
FIG. 7 is a graph showing an increase of blue-series saturation by which the power consumption for the saturation adjustment unit is decreased in accordance with an example embodiment of the present invention.

FIG. 7 is a graph showing an increase of blue-series saturation by which the power consumption for the saturation adjustment unit 50 is decreased in accordance with an example embodiment of the present invention.

Figure 8:
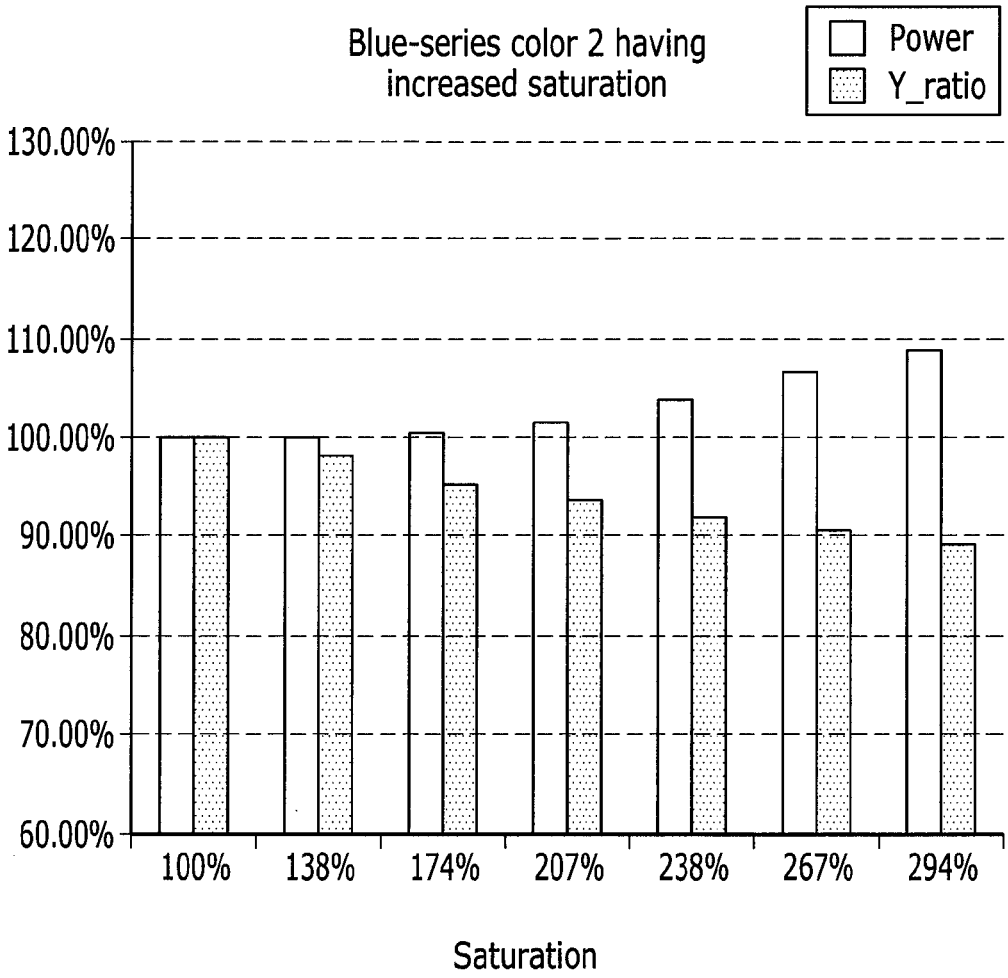
FIG. 8 is a graph showing an increase of blue-series saturation by which the power consumption for the saturation adjustment unit is increased in accordance with an example embodiment of the present invention.

FIG. 8 is a graph showing an increase of blue-series saturation by which the power consumption for the saturation adjustment unit is increased in accordance with an example embodiment of the present invention.

The saturation adjustment unit 50 in accordance with an example embodiment of the present invention is described below with reference to FIGS. 3 to 8.

As shown in CIE 1976 color coordinate of FIG. 4, the saturation adjustment unit 50 can increase the saturation of each of the RGB images of the RGB image signal of the input original image data signal DATA1 concurrently (e.g., simultaneously) or sequentially.

For example, the saturation adjustment unit 50 can increase the image data (e.g., increase image color saturation) of a first color (e.g., green) and decrease one or more of image data (e.g., decrease one or more image color saturation) indicative of a second color (e.g., red) and a third color (e.g., blue), which are different from the first color, to increase the saturation of the first color of a received original image data signal DATA1 and generate compensation data using the increased image data and the decreased one or more image data.

The saturation adjustment unit 50 calculates luminance data, saturation data, and power consumption, calculates a compensation ratio by taking the luminance data, saturation data, and power consumption into consideration, compares the compensation ratio with a reference value (e.g., a predetermined reference value), and generates compensation image data based on a result of the comparison so that the compensation ratio exceeds the reference value.

More particularly, as shown in FIG. 5, the saturation adjustment unit 50 increases the saturation of the green image of the original image data signal DATA1 up to a first threshold value (e.g., 300%) at which point power consumption is reduced. Here, because a portion of the luminance of the green image is large, the saturation adjustment unit 50 increases the data of the green image while maintaining a rate of change of the luminance Y_ratio of the display panel 10 at about 100% and generates the compensation image data signal SDATA based on the increased data.

As shown in FIG. 6, the saturation adjustment unit 50 increases the saturation of the red image of the original image data signal DATA1 up to a second threshold value (e.g., 285%) at which point power consumption is reduced. Here, it can be seen that power consumption is reduced as the saturation is improved because the saturation of red is increased and the saturation of each of green and blue is reduced, but a rate of change of luminance Y_ratio is reduced by about 10% due to the decreased saturation of green.

However, the saturation adjustment unit 50 generates the compensation image data signal SDATA so that saturation is increased by about three times (e.g., 285%) even though a rate of change of luminance is decreased by about 10% and thus an excellent visual characteristic is maintained.

As shown in FIGS. 7 and 8, the saturation adjustment unit 50 can increase the saturation of the blue image of the original image data signal DATA1.

More particularly, as shown in FIG. 7, the saturation adjustment unit 50 increases the saturation of the blue image of the original image data signal DATA1 up to a third threshold value (e.g., 300%) at which point power consumption is reduced.

Furthermore, in the case of blue saturation, as shown in FIG. 8, power consumption may increase as a result of an increase of the saturation because a portion of the blue luminance of the display panel 10 is very small. Here, the saturation adjustment unit 50 increases the saturation of the blue image up to a fourth threshold value (e.g., 174%) at which point power consumption is not increased.

The saturation adjustment unit 50, in accordance with an example embodiment of the present invention, includes a luminance calculator 210, a saturation calculator 220, a saturation adjuster 230, and a power consumption calculator 240.

The luminance calculator 210 calculates luminance data (e.g., just-before luminance data [or preceding luminance data] calculated based on the luminance data of the RGB image signal of the original image data signal DATA1) and sends the calculated luminance data (e.g., the just-before luminance data) to the saturation adjuster 230.

Furthermore, the luminance calculator 210 calculates luminance data (e.g., current luminance data calculated based on the RGB data of compensation image data) and sends the calculated luminance data (e.g., the current luminance data) to the saturation adjuster 230.

The luminance calculator 210 calculates the luminance data in accordance with a Y value calculation equation for a YCbCr color space, and detailed luminance data calculation is performed in accordance with Equation 1 below. When calculating the luminance data, a portion of each of red, green, and blue can be slightly adjusted according to the characteristics of a display panel.

$$\text{Luminance } Y=0.2*R+0.6*G+0.1*B \quad \text{[Equation 1]}$$

(Using Luminance Portions of Red, Green, and Blue)

The saturation calculator 220 calculates saturation data (e.g., just-before saturation data [or preceding saturation data] calculated based on the luminance data of the RGB image signal of the original image data signal DATA1) and sends the calculated saturation data (e.g., the just-before luminance data) to the saturation adjuster 230.

Furthermore, the saturation calculator 210 calculates saturation data (e.g., current saturation data calculated based on the RGB data of the compensation image data) and sends the calculated saturation data (e.g., the current saturation data) to the saturation adjuster 230.

The saturation calculator 220 calculates the saturation data using the HSI color space, and detailed saturation calculation is performed in accordance with Equation 2 below.

The saturation calculator 220 performs color space using HSI to RGB conversion and RGB to HSI conversion.

$$\text{Saturation}=1-\text{Min}(R,G,B)/\text{Max}(R,G,B) \quad \text{[Equation 2]}$$

The saturation adjuster 230 compares the just-before luminance data with the current luminance data, calculates a rate of change of the luminance based on a result of the comparison, compares the just-before saturation data with the current saturation data, calculates a rate of change of the saturation based on a result of the comparison, compares just-before power consumption data (or preceding power consumption data) with current power consumption data, and calculates a rate of change of the power consumption based on a result of the comparison.

The saturation adjuster 230 generates the compensation image data signal SDATA and sends RGB data having increased saturation to the luminance calculator 210, the saturation calculator 220, and the power consumption calculator 240.

The saturation adjuster 230 calculates a compensation ratio in accordance with Equation 3 below, generates the compensation image data signal SDATA so that the compensation ratio is at a reference value Th or higher, and sends the generated compensation image data signal SDATA to the data driver 30.

$$[\text{Rate of change of saturation (\%)}+\text{Rate of change of luminance (\%)}]/2>Th \quad \text{[Equation 3]}$$

Here, the reference value Th refers to a threshold value at which compensation ratio external visibility is improved based on an increase of saturation even though luminance is reduced. The reference value Th is set to a value of 100% or higher.

For example, if saturation is increased by 20% and luminance is decreased by 20%, a compensation ratio is (120%+80%)/2=100%, in accordance with Equation 3. Accordingly, the saturation adjuster 230 compares the calculated compensation ratio with the reference value Th and generates the compensation image data signal SDATA based on a result of the comparison so that the compensation ratio exceeds 100%.

Furthermore, if saturation is increased by 30% and luminance is decreased by 10%, a compensation ratio is (130%+90%)/2=110%, in accordance with Equation 3. Accordingly, the saturation adjuster 230 compares the calculated compensation ratio with the reference value Th and generates the compensation image data signal SDATA based on a result of the comparison so that the compensation ratio exceeds 110%.

The saturation adjuster 230 adjusts saturation so that a compensation ratio exceeds the reference value Th.

A detailed method in which the saturation adjuster 230 calculates a compensation ratio by increasing the saturation of each of red, green, and blue images and calculates compensation data is the same as that of the saturation adjustment unit 50, and thus a detailed description thereof will not be provided.

The power consumption calculator 240 calculates power consumption data (e.g., just-before power consumption data calculated based on an external original image data signal DATA1) and sends the calculated power consumption data (e.g., the just-before power consumption data) to the saturation adjuster 230.

Furthermore, the power consumption calculator 240 calculates power consumption data (e.g., current power consumption data calculated based on the RGB data of compensation image data) and sends the calculated power consumption data (e.g., the current power consumption data) to the saturation adjuster 230.

The power consumption calculation of the power consumption calculator 240 is performed in accordance with Equation 4 below.

$$\text{Power}=(\text{red_data})\hat{}\text{gamma}+(\text{green_data})\hat{}\text{gamma}+(\text{blue_data})\hat{}\text{gamma} \quad \text{[Equation 4]}$$

(In General, Gamma is 2.2)

The saturation adjuster 230 calculates and uses power consumption calculation ratios before and after adjustment because it refers to only the increment and decrement ratios of power consumption.

Figure 9:
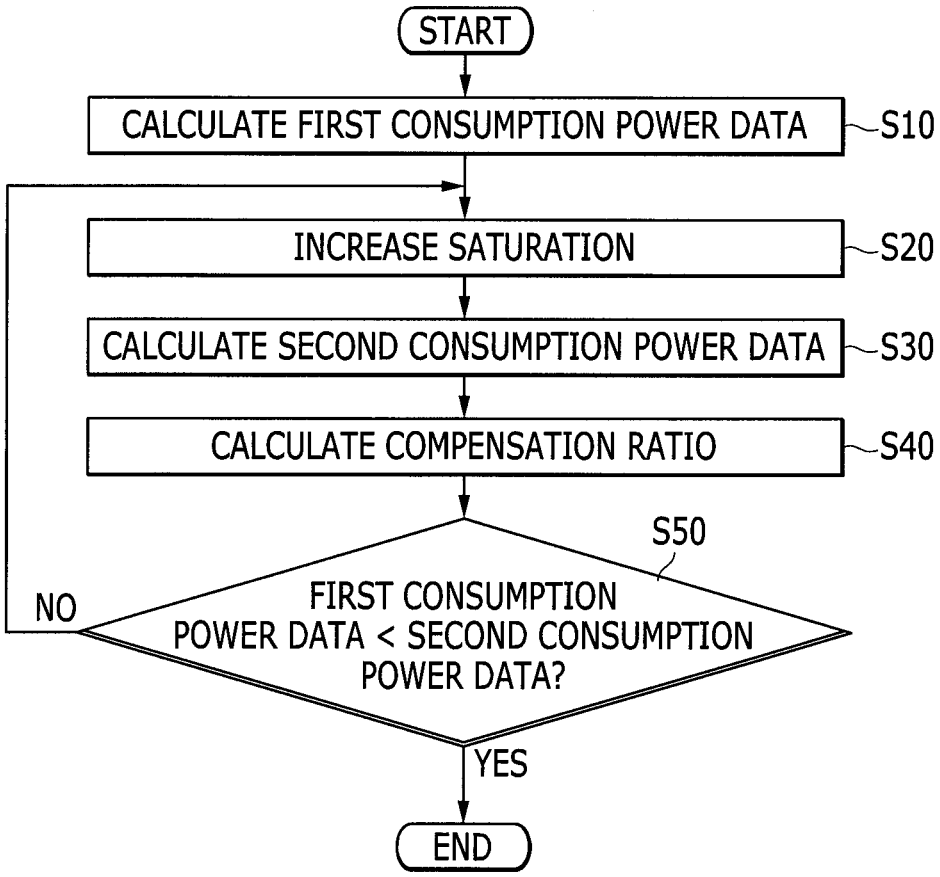
FIG. 9 is a flow diagram illustrating a method of reducing power consumption in accordance with an example embodiment of the present invention.

FIG. 9 is a flow diagram illustrating a method of reducing power consumption in accordance with an example embodiment of the present invention.

The method of reducing power consumption in accordance with an example embodiment of the present invention is described below with reference to FIG. 9.

In step S10, the saturation calculator 220 calculates the first saturation data of input image data DATA1 and sends the calculated first saturation data to the saturation adjuster 230.

The luminance calculator 210 calculates the first luminance data of the input image data DATA1 and sends the calculated first luminance data to the saturation adjuster 230.

The power consumption calculator 240 calculates the first power consumption data of the input image data DATA1 and sends the calculated first power consumption data to the saturation adjuster 230.

Detailed methods by which the saturation calculator 220, the luminance calculator 210, and the power consumption calculator 240 calculate the first saturation data, the first luminance data, and the first power consumption data, respectively, are the same as those described above, and thus a detailed description thereof will not be provided.

In step S20, the saturation adjuster 230 increases saturation by increasing image data (e.g., image saturation data) of one of the red, green, and blue of the input image data DATA1.

In step S30, the saturation calculator 220 calculates the second saturation data of the one or more image data having saturation increased by the saturation adjuster 230 and sends the calculated second saturation data to the saturation adjuster 230.

The luminance calculator 210 calculates the second luminance data of the one or more image data having saturation increased by the saturation adjuster 230 and sends the calculated second luminance data to the saturation adjuster 230.

The power consumption calculator 240 calculates the second power consumption data of the one or more image data having saturation increased by the saturation adjuster 230 and sends the calculated second power consumption data to the saturation adjuster 230.

Detailed methods by which the saturation calculator 220, the luminance calculator 210, and the power consumption calculator 240 calculate the second saturation data, the second luminance data, and the second power consumption data, respectively, are the same as those described above, and thus a detailed description thereof will not be provided.

In step S40, the saturation calculator 220 calculates a rate of change of the luminance based on the first luminance data and the second luminance data, calculates a rate of change of the saturation based on the first saturation data and the second saturation data, and calculates a compensation ratio according to the rate of change of the luminance and the rate of increase of the saturation.

In step S50, the saturation adjuster 230 compares the first power consumption data with the second power consumption data and increases one of the image data of the red, green, and blue of the input image data by repeating steps S20 to S50 so that a compensation ratio exceeds a reference value (e.g., predetermined reference value) within a range in which the second power consumption data is the same as the first power consumption data or less.

While this invention has been described in connection with what is presently considered to be practical example embodiments, it is to be understood that the invention is not limited to the disclosed embodiments, but, on the contrary, is intended to cover various modifications and equivalent arrangements included within the spirit and scope of the appended claims.

DESCRIPTION OF SOME OF THE REFERENCE CHARACTERS

| | |
|---|---|
| 10: display panel | 20: gate driver |
| 30: data driver | 40: signal controller |
| 50: saturation adjustment unit | 100: pixel |
| 210: luminance calculator | 220: saturation calculator |
| 230: saturation adjuster | 240: power consumption calculator |

What is claimed is:

1. A display device configured to reduce power consumption, the display device comprising:

a signal controller configured to calculate saturation data, luminance data, and power consumption data of input image data, to calculate a compensation ratio based on a power consumption, to generate compensation image data having a saturation of a red, green, or blue image of the input image data increased up to a threshold value so that the compensation ratio exceeds a reference value, and to send the generated compensation image data to a data driver; and the data driver configured to supply data voltages corresponding to the compensation image data, in response to gate signals sequentially generated from a gate driver to a display panel.

2. The display device of claim 1, wherein:

the threshold value is a first threshold value for limiting a size of the compensation image data indicative of the green image of the input image data, and the signal controller is configured to increase a saturation of the green image up to the first threshold value.

3. The display device of claim 1, wherein:

the threshold value is a second threshold value for limiting a size of the compensation image data indicative of the red image of the input image, and the signal controller is configured to increase a saturation of the red image up to the second threshold value.

4. The display device of claim 1, wherein:

the threshold value is a third threshold value for limiting a size of the compensation image data indicative of the blue image of the input image, and the signal controller is configured to increase a saturation of the blue image up to the third threshold value.

5. The display device of claim 1, wherein the signal controller comprises an external illuminance measurement unit, and is configured to generate the compensation image data based on an external measured illuminance, and to send the generated compensation image data to the data driver.

6. A display device configured to reduce power consumption, the display device comprising:

a signal controller configured to calculate saturation data, luminance data, and power consumption data of input image data, to calculate a compensation ratio based on a rate of change of luminance, a rate of increase of saturation, or a power consumption, to generate compensation image data having a saturation of a red, green, or blue image of the input image data increased up to a threshold value so that the compensation ratio exceeds a reference value, and to send the generated compensation image data to a data driver; and the data driver configured to supply data voltages corresponding to the compensation image data, in response to gate signals sequentially generated from agate driver to a display panel, wherein the signal controller comprises:

a luminance calculator configured to calculate the luminance data of the input image and to send the calculated luminance data to a saturation adjuster;

a saturation calculator configured to calculate the saturation data of the input image and to send the calculated saturation data to the saturation adjuster;

a power consumption calculator configured to calculate the power consumption data of the input image and to send the calculated power consumption data to the saturation adjuster; and the saturation adjuster configured to increase image data indicative of a first color image of the input image data and to decrease one or more image data indicative of respective second and third colors of the input image data, the second color image and third color image being different from the first color image, to generate a preliminary compensation image data based on the increased image data and the decreased one or more image data, to receive compensated luminance data, compensated saturation data, and compensated power consumption data according to the preliminary generated compensation image data, to calculate the compensation ratio based on the received compensated luminance data, compensated saturation data, and compensated power consumption data, to generate compensation image data based on the calculated compensation ratio so that the calculated compensation ratio exceeds the reference value, and to send the generated compensation image data to the data driver.

7. The display device of claim 6, wherein:

the luminance data comprises preceding luminance data calculated based on the luminance data of the input image data and current luminance data calculated based on the compensation image data, the saturation data comprises preceding saturation data calculated based on the saturation data of the input image data and current saturation data calculated based on the compensation image data, and the power consumption data comprises preceding power consumption data calculated based on the input image data and current power consumption data calculated based on the compensation image data.

8. The display device of claim 7, wherein the saturation adjuster compares the preceding luminance data with the current luminance data, calculates the rate of change of luminance based on a result of the comparison of the luminance data, compares the preceding saturation data with the current saturation data, calculates the rate of change of saturation based on a result of the comparison of the saturation data, calculates the compensation ratio using the rate of change of luminance and the rate of change of saturation, compares the preceding power consumption data with the current power consumption data, and calculates a rate of change of power consumption based on a result of the comparison of the power consumption data.

9. The display device of claim 8, wherein the current power consumption data of the compensation image data is smaller than or equal to the preceding power consumption data.

10. A method of reducing power consumption, comprising the acts of:

(A) calculating first saturation data, first luminance data, and first power consumption data of input image data;

(B) increasing a saturation of a red, green, or blue image of the input image data;

(C) calculating second saturation data, second luminance data, and second power consumption data of the image data comprising the increased saturation;

(D) calculating a rate of change of luminance using the first luminance data and the second luminance data, calculating a rate of change of saturation using the first saturation data and the second saturation data, and calculating a compensation ratio based on the rate of change of luminance and the rate of change of saturation; and (E) comparing the first power consumption data with the second power consumption data and increasing image data of the red, green, or blue of the input image data by repeating the acts (B) to (D) so that the compensation ratio exceeds a threshold value within a range in which the second power consumption data is same as the first power consumption data or smaller based on a result of the comparing the first power consumption data with the second power consumption data.

11. The method of claim 10, wherein:

the threshold value is a first threshold value limiting a size of compensation image data indicative of the green image of the input image data, and the act (E) comprises increasing a saturation of the green image up to the first threshold value.

12. The method of claim 10, wherein:

the threshold value is a second threshold value limiting a size of compensation image data indicative of a red image of the input image, and the act (E) comprises increasing a saturation of the red image up to the second threshold value.

13. The method of claim 10, wherein:

the threshold value is a third threshold value limiting a size of compensation image data indicative of a blue image of the input image data, and the act (E) comprises increasing a saturation of the blue image up to the third threshold value.

14. The method of claim 10, wherein:

the act (B) comprises increasing image data of a first color image of the input image data and decreasing image data of one or more of a second color image and a third color image of the input image data, the second color image and third color image being different from the first color image.

15. A display device configured to reduce power consumption, the display device comprising:

a signal controller configured to calculate saturation data, luminance data, and power consumption data of input image data, to calculate a compensation ratio based on a rate of change of luminance, a rate of increase of saturation, or a power consumption, to generate compensation image data having a saturation of a red, green, or blue image of the input image data increased up to a threshold value so that the compensation ratio exceeds a reference value, and to send the generated compensation image data to a data driver; and the data driver configured to supply data voltages corresponding to the compensation image data, in response to gate signals sequentially generated from a gate driver to a display panel, wherein the threshold value is a first threshold value for limiting a size of the compensation image data indicative of one of the green image, the blue image, and red image of the input image data, and wherein the signal controller is configured to increase a saturation of the one of the green image, the blue image, and red image up to the first threshold value.

16. The display device of claim 15, wherein the signal controller comprises an external illuminance measurement unit, and is configured to generate the compensation image data based on an external measured illuminance, and to send the generated compensation image data to the data driver.

* * * * *